US007040282B2

(12) United States Patent
Andersson et al.

(10) Patent No.: US 7,040,282 B2
(45) Date of Patent: May 9, 2006

(54) INDEPENDENT TIMING RETARD FOR ENGINE SPEED LIMITING

(75) Inventors: Martin N. Andersson, Caro, MI (US); George M. Pattullo, Caro, MI (US)

(73) Assignee: Walbro Engine Management, L.L.C., Tucson, AZ (US)

( * ) Notice: Subject to any disclaimer, the term of this patent is extended or adjusted under 35 U.S.C. 154(b) by 16 days.

(21) Appl. No.: 10/955,707

(22) Filed: Sep. 30, 2004

(65) Prior Publication Data

US 2006/0065236 A1 Mar. 30, 2006

(51) Int. Cl.
*F02P 9/00* (2006.01)

(52) U.S. Cl. ..... 123/335; 123/351; 123/406.59

(58) Field of Classification Search ..... 123/334, 123/335, 351, 406.59
See application file for complete search history.

(56) References Cited

U.S. PATENT DOCUMENTS 4,075,989 A * 2/1978 Nagasawa ..... 123/406.57
4,344,395 A * 8/1982 Kondo et al. ..... 123/406.57
4,572,150 A * 2/1986 Foster ..... 123/335
5,036,802 A 8/1991 D'Amours
5,038,743 A * 8/1991 Remmers ..... 123/406.57
5,245,965 A 9/1993 Andersson
5,517,962 A * 5/1996 Ling ..... 123/335
6,109,235 A 8/2000 Hoshiba et al.
6,388,445 B1 5/2002 Andersson
6,758,189 B1 7/2004 Uraki et al.
6,792,912 B1 * 9/2004 Kikuchi et al. ..... 123/294
6,938,609 B1 * 9/2005 Kustosch ..... 123/351
2003/0015175 A1 1/2003 Andersson et al.

* cited by examiner

*Primary Examiner*—Erick Solis
(74) *Attorney, Agent, or Firm*—Reising, Ethington, Barnes, Kisselle, P.C.

(57) ABSTRACT

A method and system for operating an engine wherein ignition of the engine is activated according to a predetermined timing schedule that references engine speed, and the ignition is suppressed above a predetermined engine speed threshold to allow engine speed to fall below the predetermined engine speed threshold. Thereafter, ignition is reactivated according to timing that is retarded relative to the predetermined timing schedule for a predetermined number of engine revolutions substantially when the engine speed has fallen below the predetermined engine speed threshold, thereby mitigating undesirable spikes in combustion chamber maximum pressure.

22 Claims, 4 Drawing Sheets

Timing Table:

| Point # | RPM | Timing (BTDC°) | Spark Ratio |
|---|---|---|---|
| 1 | 300 | No spark | ALL |
| 2 | 500 | No spark | ALL |
| 3 | 1000 | 0 | ALL |
| 4 | 1500 | 0 | ALL |
| 5 | 2000 | 15 | ALL |
| 6 | 2500 | 25 | ALL |
| 7 | 3000 | 25.5 | ALL |
| 8 | 3500 | 25.5 | ALL |
| 9 | 4000 | 26 | ALL |
| 10 | 4500 | 26 | ALL |
| 11 | 5000 | 27 | ALL |
| 12 | 5500 | 27 | ALL |
| 13 | 6000 | 27.5 | ALL |
| 14 | 6500 | 28 | ALL |
| 15 | 7000 | 28 | ALL |
| 16 | 7500 | 28 | ALL |
| 17 | 8000 | 25 | ALL |
| 18 | 8500 | 25 | ALL |
| 19 | 9000 | 25 | ALL |
| 20 | 9500 | 25 | ALL |
| 21 | 10000 | 25 | ALL |
| 22 | 10500 | 25 | ALL |

INDEPENDENT TIMING RETARD FOR ENGINE SPEED LIMITING

FIELD OF THE INVENTION

This invention relates generally to methods and systems for operating internal combustion engines and more particularly to methods and systems for regulating engine speed by suppressing engine ignition and controlling engine ignition timing.

BACKGROUND OF THE INVENTION

Many internal combustion engines use various methods and systems for regulating engine speed so as to avoid engine overspeed conditions. Engine overspeed occurs when the engine is operating at high speed, such as wide-open-throttle, and some workload is suddenly removed from the engine, such as when a blade of an engine-powered chainsaw finally breaks through a log it is cutting. Among the options for regulating engine speed, some engine designs incorporate fuel flooding, ignition timing retard, or ignition suppression.

With any of these options, a spark-ignition engine cycle includes a compression stroke wherein a piston compresses an air-fuel mixture within an engine combustion chamber, which is defined by an engine cylinder and a top surface of the piston. The cycle also includes an ignition event wherein a spark plug ignites the compressed air-fuel mixture, typically when the piston is rising at a predetermined point with respect to a "top dead center" (TDC) position within the cylinder. The ignition event initiates a combustion event in which chemical energy of the air-fuel mixture is converted into thermal energy. Subsequently, the thermal energy is converted into mechanical work during a power stroke of the cycle, wherein the combustion event rapidly expands the gas volume and increases the pressure within the combustion chamber, thereby forcing the piston down away from TDC. Consequently, the linear displacement of the piston during the power stroke is converted into rotation of a crankshaft via a pivotable connecting rod.

Timing of the ignition event is an important aspect in the performance of internal combustion engines and relates to how early or late a spark plug fires relative to the location of the piston within the cylinder in reference to TDC. Because there is a slight delay between ignition and peak combustion, if ignition occurs when the piston is at TDC, the piston will have already moved well down into its power stroke before combustion gases have achieved their highest useful pressure. Therefore, to make the most efficient use of the chemical energy of the fuel, ignition should occur before the piston reaches TDC during its compression stroke. But the speed of the piston increases with overall engine speed, even though the combustion time is about constant. Therefore, the faster the engine speed, the earlier ignition needs to occur relative to the TDC position of the piston to time maximum combustion pressure levels for optimum engine performance.

For instance, when the engine is operating at relatively high speeds it is desirable to initiate combustion well before the piston reaches TDC, such that peak combustion pressure occurs immediately after the piston reaches TDC for maximum performance and efficiency. This occurrence is commonly referred to as ignition timing advance. Conversely, if the engine is being operated at relatively low speeds, it is desirable to initiate combustion when the piston is closer to TDC such as slightly before or slightly after TDC. Moreover, ignition timing is "advanced" or "advancing" whenever timing is being adjusted relatively away from TDC toward a piston compression position that is before top dead center (BTDC). Conversely, ignition timing is "retarded" or "retarding" whenever timing is being adjusted in a direction generally defined as progressing relatively from BTDC toward ATDC.

Engine overspeeding is a condition that can be regulated during engine cycles that exceed a predetermined high speed threshold, in accord with the several options mentioned above. According to the first option, the air-fuel mixture can be enriched so as to flood the combustion chamber with fuel and thereby partially or completely extinguish ignition. Once engine speed falls to an acceptable level, the air-fuel mixture can be normalized. Unfortunately, however, this method can be difficult to control and yields increased unburned fuel emissions that are exhausted out of the engine. According to the second option, ignition timing can be retarded closer to TDC during all overspeed engine cycles until engine speed falls to an acceptable level. But this method typically occurs over an unacceptable number of engine cycles and yields engine inefficiency and high exhaust gas temperatures, which can harm various components of the engine.

With the third option, ignition can be suppressed during overspeed engine cycles, such as by intermittent ignition or ignition cutoff. Once engine speed falls to an acceptable level, ignition can be normalized or reactivated. In the meantime, however, more and more fuel tends to accumulate in the combustion chamber and, once ignition is reactivated, combustion tends to be intensified by the accumulated fuel. Such combustion yields undesirable spikes in pressure in the combustion chamber that can be damaging to engine components and that otherwise create undesirable noise, vibration, excessive engine heating, high exhaust gas temperatures, and harshness in engine operation.

In sum, current approaches at engine speed limiting and recovery are not yet fully optimized for fuel efficiency, engine integrity, and smooth engine operation.

SUMMARY OF THE INVENTION

An exemplary method and system for operating an engine is provided, wherein engine ignition is activated according to a predetermined timing schedule that references engine speed. Engine ignition is suppressed above a predetermined engine speed threshold so that engine speed falls below the predetermined engine speed threshold, and thereafter engine ignition is reactivated according to timing that is retarded relative to the predetermined timing schedule for a predetermined number of engine revolutions, thereby mitigating undesirable spikes in the maximum combustion chamber pressure.

According to another aspect of the present invention, another exemplary method and system are provided for controlling ignition of an engine, wherein a signal representative of engine revolutions is converted into an engine speed value. Thereafter, the engine speed value is compared to a predetermined engine speed threshold, and a timing advance signal is generated in accordance with a predetermined timing schedule. When the engine speed value exceeds the predetermined engine speed threshold, an ignition suppression signal is generated to enable the engine speed to fall below the predetermined engine speed threshold. Thereafter, a timing retard signal is generated for at least a portion of at least one revolution of the engine.

At least some of the objects, features and advantages that may be achieved by at least certain embodiments of the invention include providing an ignition method and system that is readily adaptable to various engine applications and that is particularly well-suited for light duty engines; includes a facility for limiting potentially damaging overspeed operation of the engine, and yet tends not to yield excessive unburned fuel to the engine exhaust, or excessive exhaust gas temperatures, or undesirable potentially damaging combustion chamber pressure spikes; increases the in service useful life of an engine; and is otherwise of relatively simple design and economical manufacture and assembly, is reliable and in service has a long useful life.

Of course, other objects, features and advantages will be apparent in view of this disclosure to those skilled in the art. Other ignition systems, engines, and the like embodying the invention may achieve more or less than the noted objects, features or advantages.

BRIEF DESCRIPTION OF THE DRAWINGS

These and other objects, features and advantages of the present invention will be apparent from the following detailed description of the preferred embodiment(s) and best mode, appended claims, and accompanying drawings in which:

DETAILED DESCRIPTION OF THE PREFERRED EMBODIMENTS

Figure 1:
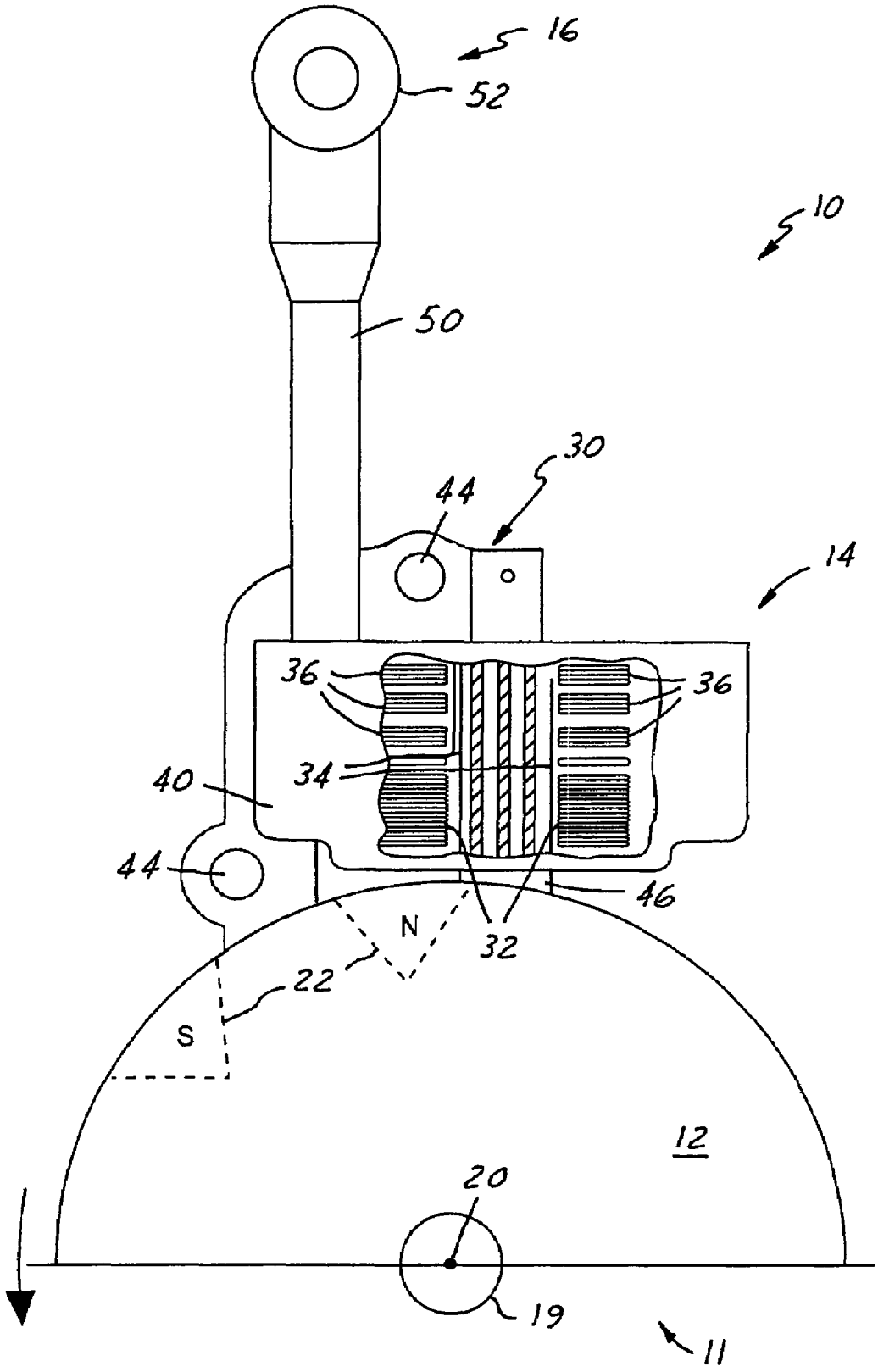
FIG. 1 is a partial cutaway semi-schematic view of an engine and control system according to an exemplary embodiment of the present invention.

Referring in more detail to the drawings, FIG. 1 illustrates an exemplary signal generation or ignition system 10 for use with a low cost, light duty internal combustion engine 11, such as the type typically employed by hand-held and ground-supported lawn and garden equipment. Such equipment includes chainsaws, trimmers, lawn mowers, and the like. The ignition system 10 could be constructed according to one of numerous designs, including magneto or capacitive discharge designs, such that it interacts with an engine flywheel 12 and generally includes a control system 14, and an ignition boot 16 for connection to a spark plug (not shown).

The flywheel 12 is a weighted disk-like component that is coupled to an engine crankshaft 19 and thus rotates about an axis 20 under the power of the engine 11. By using its rotational inertia, the flywheel 12 moderates fluctuations in engine speed, thereby providing a more constant and even output. The flywheel 12 includes magnets or magnetic sections 22 located near the outer circumference of the flywheel 12. Once the flywheel 12 is rotating, these magnetic sections 22 spin past and electromagnetically interact with components of the control system 14 for sensing engine speed among other things. Engine speed is synonymous with engine revolution frequency and plays a role in the operation of the ignition timing control, as will be explained herein below.

The control system 14 is specifically positioned in close proximity to the outer circumference of the flywheel 12, and generally includes a ferromagnetic stator core or lamstack 30 having wound thereabout a charge winding 32, a primary ignition winding 34, and a secondary ignition winding 36. The primary and secondary windings 34, 36 basically define a step-up transformer or ignition coil used to fire the spark plug. The control system also includes a circuit 38 (shown in FIG. 2), and a housing 40, wherein the circuit 38 may be located remotely from the lamstack 30 and the various windings.

Figures 2, 4:
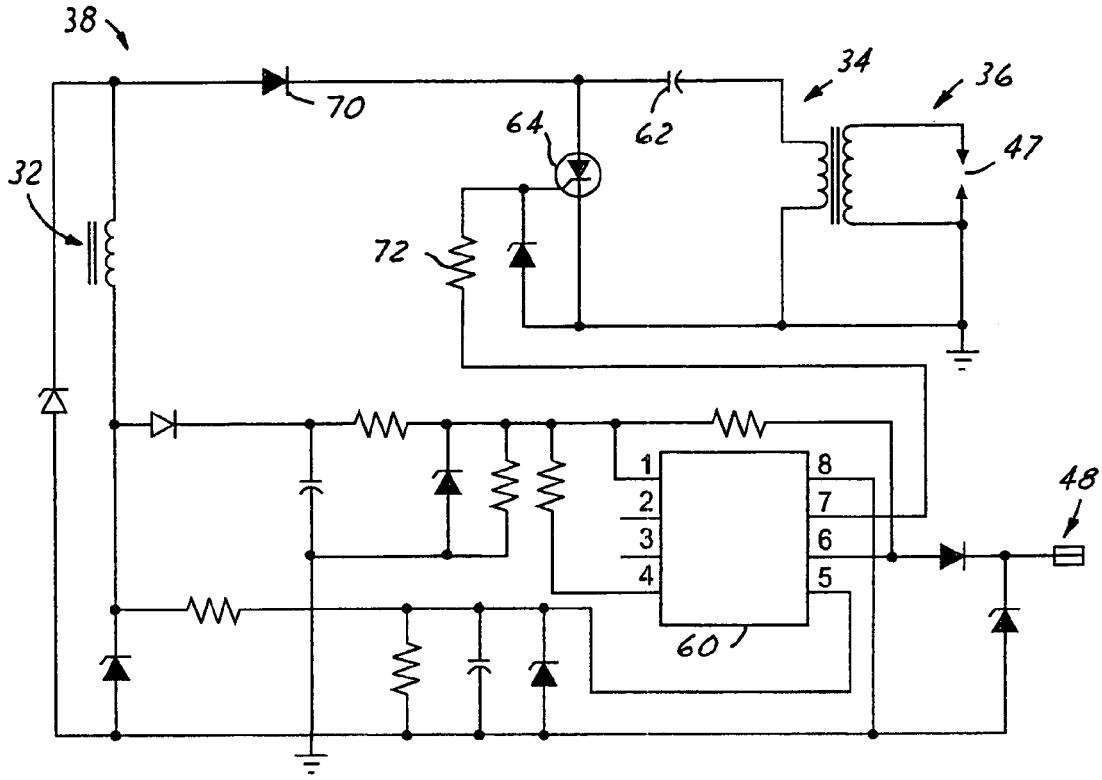
FIG. 2 is a schematic diagram of a circuit of the control system of FIG. 1.
FIG. 4 is an example of a lookup table that may be used with the operational steps shown by FIG. 3.

As the magnetic sections 22 rotate past the lamstack 30, a magnetic field is introduced into the lamstack 30 that, in turn, induces a voltage in the various windings. For example, the rotating magnetic sections 22 induce a voltage signal in the charge winding 32 that is indicative of the number of revolutions of the engine 11 in the control system. The signal can be used to determine the rotational speed of the flywheel 12 and crankshaft 19 and, hence, the engine 11. Finally, the voltage induced in the charge winding 32 is also used to power the circuit 38 (FIG. 2) and charge an ignition discharge capacitor 62 (FIG. 2). The current pulses produced in the charge winding 32 are used to charge the discharge capacitor 62, which is subsequently discharged upon activation of a trigger signal. To fully charge the discharge capacitor 62 before receipt of the trigger signal, the magnets of the flywheel 12 are preferably clocked in reference to the TDC position of the engine piston as connected to the crankshaft 19 in accordance with a predetermined adjustment angle, such as 13° advanced (BTDC). Upon receipt of the trigger signal, the capacitor 62 discharges through the primary winding 34 of the ignition coil to induce a stepped-up high voltage in the secondary winding 36 of the ignition coil that is sufficient to cause a spark of tens of thousands of volts across a spark gap of a spark plug 47 (FIG. 2) to ignite a fuel and air mixture within a combustion chamber of the engine. Like the charge winding 32, the primary ignition winding 34 is also designed to circumferentially surround the lamstack 30 on the order of tens of turns and inductively interacts mostly with the secondary ignition winding 36 that also circumferentially surrounds the lamstack 30, on the order of tens of thousands of turns.

The housing 40 can be made of plastic and protects the components of the control system 14. Mounting holes 44 are used to secure the ignition system 10 in place such that a small air gap 46 exists between the lamstack 30 and the outer circumference of the flywheel 12. The airgap 46 should be small enough to allow for sufficient electromagnetic coupling, yet large enough to account for tolerance variances in the components so that the flywheel 12 does not physically contact the lamstack 30.

The ignition boot 16 connects the control system 14 to the spark plug 47 and generally includes an elongated copper wire connector 50 and a fastening end 52. The connector 50 conducts the high voltage ignition pulse triggered by the control system 14 along an electrical conductor surrounded by a protective sheathing. The fastening end 52 is designed to receive a terminal end of the spark plug, such that the two components are physically secured to each other as well as being in electrical contact.

In normal engine operation, downward movement of an engine piston during a power stroke drives a connecting rod (not shown) that, in turn, rotates the crankshaft 19, which rotates the flywheel 12. As the magnetic sections 22 rotate past the lamstack 30, a magnetic field is created which induces a voltage in the nearby charge winding 32 which is used for several purposes. First, the voltage may be used to provide power to the control system 14, including components of circuit 38 (seen in FIG. 2). Second, the induced voltage is used to charge the main discharge capacitor 62 that stores the energy until it is instructed to discharge, at which time the capacitor 62 discharges its stored energy across primary ignition winding 34. Lastly, the voltage induced in the charge winding 32 is used to produce an engine speed input signal, which is supplied to a microcontroller 60 of the circuit 38. This engine speed input signal plays a role in the operation of the ignition timing of the present invention, and it is typically the only operating parameter being monitored but it is contemplated that other operating parameters could be monitored such as temperature, throttle position, and the like.

The microcontroller 60 receives the engine speed signal from the charge winding 32 and executes a series of instructions based upon this signal and the particular operating sequence the engine is currently in. That series of instructions may be used to determine a desired ignition timing advance or retard. Subsequently, the microcontroller 60 transmits an ignition timing signal which causes a high voltage ignition pulse to be sent to the spark plug.

Description of Electrical Circuit

Referring now primarily to FIG. 2, the control system 14 includes the circuit 38 as an example of the type of circuit that may be used to implement the ignition timing control system 14. However, many variations of this circuit 38 may alternatively be used without departing from the scope of the invention. The circuit 38 interacts with the charge winding 32, primary ignition winding 34, and preferably a kill switch 48, and generally comprises the microcontroller 60, an ignition discharge capacitor 62, and an ignition thyristor 64.

The microcontroller 60 as shown in FIG. 2 is preferably an 8-pin, 4 MHz processor, such as model # 12C509 produced by Microchip, Inc., which utilizes 1024 Kb of memory to store code for the ignition timing as well as memory for variables. Any other desired controllers, microcontrollers, or microprocessors may be used, however. Pin 1 of the microcontroller 60 is coupled to the charge winding 32 via a resistor and diode, such that an induced voltage in the charge winding 32 is rectified and supplies the microcontroller with power. Also, when a voltage is induced in the charge winding 32, as previously described, current passes through a diode 70 and charges the ignition discharge capacitor 62, assuming the ignition thyristor 64 is in a non-conductive state. The ignition discharge capacitor 62 holds the charge until the microcontroller 60 changes the state of the thyristor 64. Microcontroller pin 5 is coupled to the charge winding 32 and receives an electronic signal representative of the engine speed. The microcontroller uses this engine speed signal to select a particular operating sequence, the selection of which affects the desired spark timing. Pin 6 is coupled to the kill switch 48, which acts as a manual override for shutting down the engine. Pin 7 is coupled to the gate of the thyristor 64 via a resistor 72 and transmits from the microcontroller 60 an ignition signal which controls the state of the thyristor 64. When the ignition signal on pin 7 is low, the thyristor 64 is nonconductive and the capacitor 62 is allowed to charge. When the ignition signal is high, the thyristor 64 is conductive and the capacitor 62 discharges through the primary winding 34, thus causing an ignition pulse to be induced in the secondary winding 36 and sent on to the spark plug 47. Thus, the microcontroller 60 governs the discharge of the capacitor 62 by controlling the conductive state of the thyristor 64. Lastly, pin 8 provides the microcontroller 60 with a ground reference.

To summarize the operation of the circuit, the charge winding 32 experiences an induced voltage that charges ignition discharge capacitor 62, and provides the microcontroller 60 with power and an engine speed signal. The microcontroller 60 executes a series of instructions, which utilize the engine speed signal to determine if and how much of a spark advance or retard is needed. The microcontroller 60 then outputs an ignition signal on pin 7, according to the calculated ignition timing, which turns on the thyristor 64. Once the thyristor 64 is conductive, a current path through the thyristor 64 and the primary winding 34 is formed for the charge stored in the capacitor 62. The current discharged through the primary winding 34 induces a high voltage ignition pulse in the secondary winding 36. This high voltage pulse is then delivered to the spark plug 47 where it arcs across the spark gap thereof, thus igniting an air-fuel charge in the combustion chamber to initiate the combustion process. If at any time the kill switch 48 is activated, the microcontroller 60 halts operation and thereby prevents the ignition system 14 from delivering a spark to the combustion chamber of the engine.

Description of System Function

Figure 3:
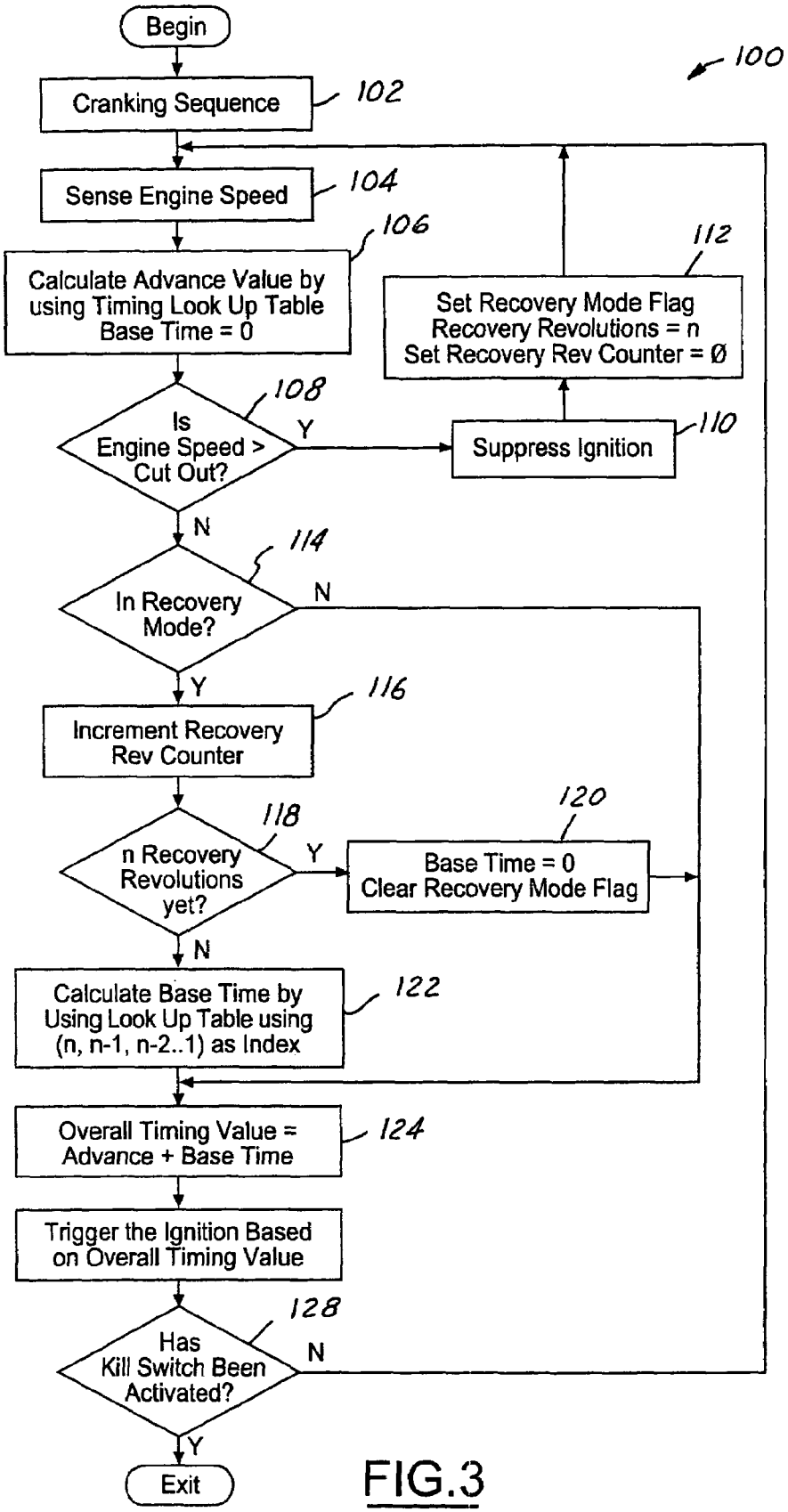
FIG. 3 is a flowchart showing the operational steps of the control system of FIG. 2.

Referring now in general to FIGS. 3 and 4, the control system of the present invention uses various instructions to calculate the ignition timing according to the speed and particular operating sequence of the engine. An Overall Timing Value dictates the ignition timing and is determined by adding together an ignition timing Advance Value and a BaseTime Value that may represent a retarded timing value. The Advance Value represents normal operation ignition timing and is generally unaffected by the specific engine operational sequences. The BaseTime Value is an additional timing value that may be determined according to certain operational sequences, such as those disclosed herein below and/or the operational sequences disclosed in U.S. Patent Application Publication 2003/0015175 A1, which is assigned to the assignee hereof and is hereby incorporated by reference herein in its entirety. Therefore, the Overall Timing Value is the sum of the Advance and BaseTime Values and, typically, may vary from 45° BTDC to 15° ATDC, depending on what is required for desired engine performance under certain specified conditions.

Referring now primarily to FIG. 3, the overall operation 100 of the control system is shown from when the engine is initially started until the operator engages the kill switch to shut the engine off. The operational sequences shown are groups of instructions, similar to sub-routines, that are designed to control the ignition timing in light of current engine conditions.

After being initially turned on, the engine ignition timing is controlled by a Cranking Sequence 102, which is designed to get the engine started and is only in control of the ignition timing for a small number of engine revolutions. Thus, the Cranking Sequence 102 is only engaged upon starting of the engine, and is disclosed in the incorporated U.S. Patent Application Publication 2003/0015175 A1. After the Cranking Sequence 102, the control system of the present invention operates according to a Normal Mode until certain circumstances, such as unusual engine speeds, cause the operation to transfer to certain other modes that are designed to operate the engine in light of those certain circumstances. For example, Speed Limiting and Recovery Modes quickly and effectively return engine speed back to an acceptable normal operating range without exhausting excessive unburned fuel, without unduly increasing exhaust gas temperatures over an unacceptable sustained number of engine revolutions or cycles, and without generating undesirable combustion chamber maximum pressure spikes.

For ignition timing in the Normal Mode of the process 100, the microcontroller 60 preferably uses a timing look-up table to cross-reference present engine speed with predetermined desired timing values to determine the Advance Value and sets the BaseTime Value to zero. More specifically, in step 104 of the process 100 the microcontroller samples and stores the current speed of the engine, as is done for each engine revolution. As previously mentioned, a count of engine revolutions can be determined from the engine speed signal, and vice-versa. Thus, by sampling either an engine speed signal or an engine revolution counter signal and converting to engine speed, both parameters would be known. Alternatively, the present invention contemplates use of a means for more finely measuring revolutions and or engine speed. For example, a separate speed sensor (not shown) could be adapted for sensing teeth or the like on the flywheel or crankshaft, and could also be adapted to communicate with the microcontroller. In either case, those of ordinary skill in the art will recognize that engine speed is determinable as a function of engine revolution pulses received over a known period of time as provided by a capacitor, or, a clock element or the like in the microprocessor or associated with the microprocessor.

In step 106 of the process 100, the engine speed signal is referred to by a look-up table that relates given engine speeds to preferred ignition timing for those given engine speeds. Different engines may use different look-up tables, as each look-up table is designed for a particular engine and application. In any event, FIG. 4 illustrates one exemplary timing look-up table that is appropriate for use with the present invention with a given 4-stroke engine. The invention may also be sued with a 2-stroke engine. As can be seen, the table includes an engine speed column and a timing reference column wherein each row of the columns relates a preferred ignition timing value to a current engine speed value. For example, once the engine has reached a high speed operating range at 8,000 revolutions per minute (RPM) and above, the timing value extracted from the table is 25° BTDC. This timing value referenced for a particular engine speed is the Advance Value discussed in the previous section. The timing values in the table are preferably empirically verified with testing of a particular engine to yield optimal performance of that engine. In other words, timing values at given engine speeds will vary with different engine designs and different desired performance criteria. Still referring to step 106 of FIG. 3, the BaseTime value is set to zero, thus making the Overall Timing value (Advance+BaseTime) simply equal to the Advance value. In this example, the Overall Timing Value would be 25°+0°=25° BTDC.

Following step 106 is decision step 108, which determines whether or not operation of the system will enter a Speed Limiting Mode. In step 108 of the process 100, the microcontroller compares current engine speed with a predetermined engine speed threshold or ignition cut-out speed. If in the Normal Mode it is ever detected that engine speed exceeds such a predetermined speed or high speed threshold, then the microcontroller initiates the Speed Limiting Mode, as will be more fully described in detail herein below.

In step 110, as part of the Speed Limiting Mode, an ignition suppression loop is carried out whenever the control system senses engine speed exceeding one or more predetermined thresholds. Specifically, the microcontroller generates an ignition suppression signal in step 110, wherein the ignition may be suppressed above one or more predetermined engine speed thresholds. In other words, the microcontroller does not permit any discharge of the main discharge capacitor 62 such that the ignition coil does not fire the spark plug. Or, the microcontroller may intermittently or otherwise minimally permit discharge of the main discharge capacitor such that the ignition coil intermittently or otherwise minimally fires the spark plug. In other words, ignition operation may be limited but not completely inhibited such as by enabling ignition spark for alternate power strokes. In any event, engine speed is allowed to fall below the one or more predetermined thresholds.

In step 112, a recovery mode flag is set to "n" predetermined number of recovery revolutions. Any desired number of engine revolutions may be used to carry out the Recovery Mode. The recovery mode flag is later used in comparing the flag to the number of actual revolutions the engine makes after the flag is set, as will be described herein below.

The ignition suppression loop repeats until the engine drops below the ignition cut-out speed. In each loop, the microcontroller proceeds from step 112 back to step 104, wherein engine speed is sensed, read, or otherwise determined by the microcontroller based on the charge winding pulses, speed sensor pulses, or otherwise. As used herein the terms sense, read, determined, and the like, may be used interchangeably, and may include a calculation or conversions step in addition to a sensing or reading step. The microcontroller again proceeds on to step 106, wherein the timing Advance Value is again calculated by the most, recent engine speed data via the look-up table of FIG. 4. Thereafter, at step 108, the microcontroller again compares the sensed engine speed to the predetermined threshold value. If, at step 108, the engine speed still exceeds the predetermined threshold value, then the process returns to step 110 to repeat the ignition suppression loop, wherein the recovery mode flag is re-set to the predetermined desired number of recovery revolutions "n". If, however, at step 108, the engine speed has fallen below the predetermined threshold value, then the process instead progresses to step 114.

In step 114, the microcontroller determines whether or not the process 100 is in the Normal Mode or if it is in the Recovery Mode. For example, the microcontroller may monitor whether or not the recovery mode flag is clear or set. If clear and not set, then the process 100 is in the Normal Mode and proceeds to step 124 as will be described herein below. If it is determined that the recovery mode flag is not currently clear, but has been set, then the process 100 is in the Recovery Mode and proceeds to step 116.

In step 116, the microcontroller increments the Recovery RevCounter by one. This increment step is used in determining whether to exit the Recovery Mode in step 118.

In step 118, the microcontroller determines the status of the Recovery Mode to determine whether to continue in Recovery Mode or exit therefrom. The microcontroller compares the value of the Recovery RevCounter to that of the predetermined number of Recovery Revolutions. If the RevCounter value is equal to the predetermined number of Recovery Revolutions, then the process 100 progresses to step 120, wherein the BaseTime value is reset to 0 and the Recovery Mode Flag is cleared. Accordingly, the Recovery Mode is thereby terminated and the process 100 returns to the Normal Mode at step 124, as will be described below. If, however, at step 118, the Recovery RevCounter value is less than the predetermined number of Recovery Revolutions, then the process 100 is still in the Recovery Mode and continues on to step 122.

In step 122, the microcontroller calculates a Recovery Mode BaseTime Value used in generating a timing retard signal within the first engine revolution substantially when it is determined in step 108 that the engine speed has fallen below the predetermined threshold value. Accordingly, engine ignition is reactivated based on a predetermined ignition timing retard schedule or value. The terminology "substantially when" means that there is preferably some predetermined time tolerance within which it is acceptable for the microcontroller to act, such as within about 0 to 10 milli-seconds, as one example. It is contemplated, however, that any suitable time tolerance could be used. Moreover, the term "schedule" should be broadly construed to mean any list, spreadsheet, instructions, look-up table, formula, value (s), or the like.

In the Recovery Mode, the process 100 uses timing retard to gain control of the first predetermined number of combustion events after the ignition suppression loop(s) of the Speed Limiting Mode ceases. Preferably, the engine ignition timing is retarded for only the first combustion event after ignition suppression terminates, but may be retarded for any desired number of combustion events. For example, a preferred exemplary implementation of the present invention contemplates retarding the ignition timing from 25° BTDC at about 8,500 RPM to only 5° BTDC, for the combustion event during the first revolution after engine speed drops below about 8,500 RPM. Alternatively, however, any desired timing retard value may be used. In fact, an optimum timing retard value will need to be determined empirically for any given engine design and desired operating criteria.

Other exemplary implementations of the present invention contemplate retarding the ignition timing based on a variable schedule or look-up table of BaseTime values versus the present number of Recovery Revolutions. For example, and using the exemplary timing table from FIG. 4, during a first Recovery Revolution at about 8,500 RPM, the BaseTime value may be specified at a maximum magnitude such as −20° to yield a 5° BTDC Overall Timing Value from the 25° BTDC Advance Value. During a second Recovery Revolution, the BaseTime value may be adjusted to a lesser magnitude such as −10° to yield a 15° BTDC Overall Timing Value from the 25° BTDC Advance Value. Likewise, during a third Recovery Revolution, the BaseTime value may be adjusted to an even lesser magnitude such as −5° to yield a 20° BTDC Overall Timing Value from the 25° BTDC Advance Value. This process may be carried out over any predetermined number of Recovery Revolutions and in any desired gradations. In other words, the BaseTime value may be calculated and set to gradually advance the engine ignition timing back to or toward the Advance Value from the initially retarded timing of the first revolution in the Recovery Mode. After the BaseTime Value is calculated, the process 100 continues to step 124.

In step 124, the microcontroller determines the Overall Timing Value by adding the Advance value, which was found using the look-up table in step 106, to the present BaseTime value, which may be set to zero from steps 106 and/or 120, or may be calculated from step 122. In any case, the process 100 thereafter continues to step 126.

In step 126, the microcontroller sends an ignition signal to direct the discharge of the capacitor 62 according to the Overall Timing Value found in step 124. Following activation or triggering of engine ignition at step 126, the process 100 continues to decision step 128.

In step 128, the microcontroller checks to see if the operator has engaged the kill switch. If the kill switch is engaged, the microcontroller immediately shuts the engine down and the control system exits the process 100. If the kill switch has not been engaged, then control returns to the engine speed sensing step 104, wherein the Recovery Mode continues through to step 118 until the Recovery RevCounter is equal to the predetermined desired number of Recovery Revolutions specified by the Recovery Mode flag. Again, at such time the Recovery Mode ceases, wherein the BaseTime is set to 0 and the Recovery Mode flag cleared in step 120. Thereafter, the process reverts to the Normal Mode at step 124 wherein ignition timing is calculated based on the Advance Values of the timing table of FIG. 4. In other words, the microcontroller generates timing advance signals in accordance with the predetermined timing schedule or table. Spark and engine operation thereby return to normal without requiring operation of a manual reset switch or the like.

Figure 5:
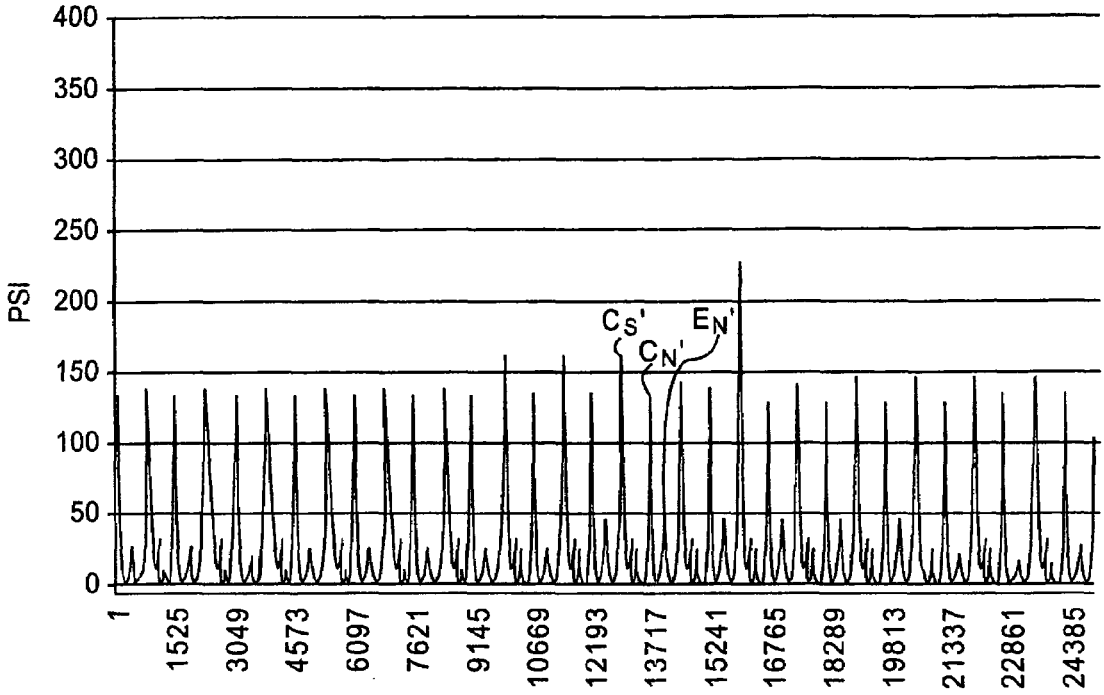
FIG. 5 is a pressure trace of combustion chamber pressure within the engine of FIG. 1.

FIG. 5 illustrates a pressure trace according to an engine having a spark suppression and timing system according to an exemplary embodiment of the present invention. Combustion chamber pressure in pounds per square inch (PSI) is plotted against data sample points according to a rate of 50,000 data points per second. FIG. 5 depicts the engine operating at a speed limiting threshold of about 8,500 RPM, under no load, with ignition timing carried out in accordance with the general Speed Limiting and Recovery Modes described above. During compression strokes with no spark, such as under the Speed Limiting Mode discussed above, the combustion chamber experiences a maximum pressure of less than about 150 PSI, as demonstrated by exemplary pressure $C_N'$. During exhaust strokes, combustion chamber pressure reduces to less than 50 PSI, as shown by exemplary pressure $E_N'$. During a power stroke under the Recovery Mode discussed above wherein timing is relatively retarded, the combustion chamber experiences a regular pattern of maximum pressures typically restrained below 150 PSI, as illustrated by exemplary pressure $C_S'$.

Figure 6:
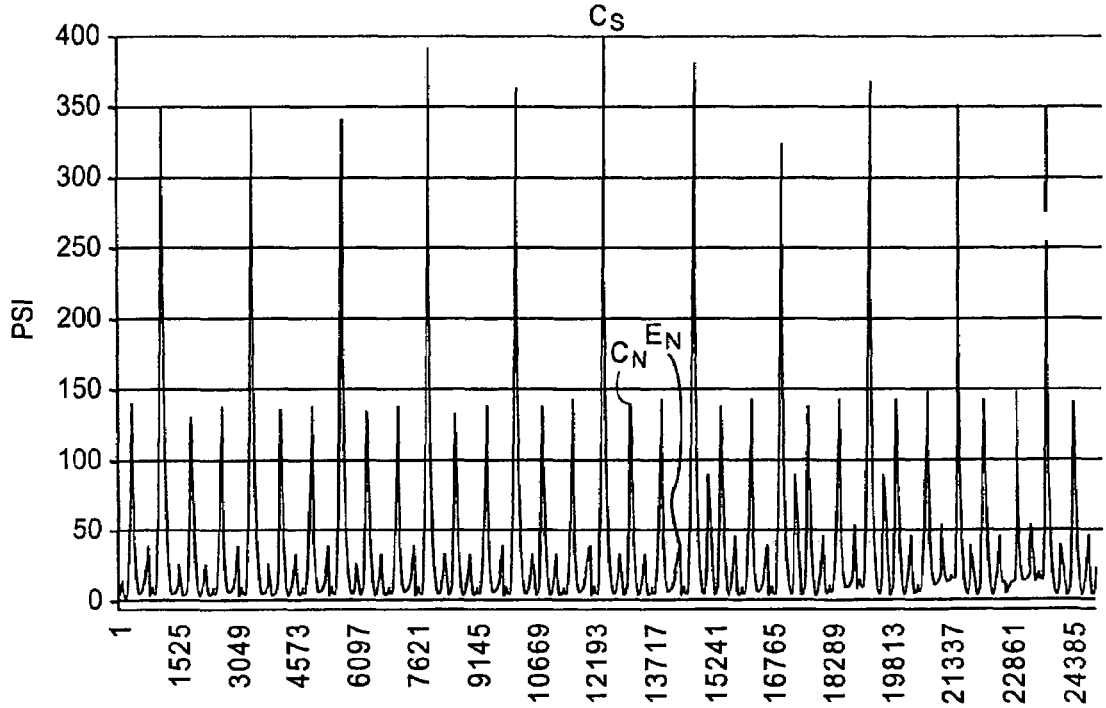
FIG.6 (Prior Art)
FIG. 6 is a pressure trace of combustion chamber pressure within an engine having a conventional control system in accordance with the prior art.

In contrast, however, FIG. 6 shows a pressure trace according to an engine having a conventional spark suppression and timing system according to the prior art, wherein maximum pressure spikes are not restrained. FIG. 6 is a plot of combustion chamber pressure in pounds per square inch (PSI) against data sample points according to a rate of 50,000 data points per second, and depicts an engine operating at a speed limiting threshold of about 8,500 RPM, under no load, with ignition timing advanced to 25° BTDC in accordance with normal operational reference to a timing table. During compression strokes with no spark, such as under a speed limiting mode, the combustion chamber undergoes less than about 150 PSI, exemplified by pressure $C_N$. And during exhaust strokes, combustion chamber pressure, reduces to less than 50 PSI as exemplified by pressure $E_N$. But, during power strokes with spark following no-spark speed-limited compression strokes, the combustion chamber experiences an irregular pattern of pressure spikes ranging from about 340 to 400 PSI, exemplified by pressure spike $C_S$ at 400 PSI. This is because, fuel has accumulated in the combustion chamber during the no-spark speed-limited compression strokes and, once ignition is reactivated according to normal timing, combustion is intensified by the combination of the accumulated fuel and the at the 25° BTDC advanced timing. Such combustion yields undesirable spikes in pressure in the combustion chamber that can be damaging to engine components and that otherwise create undesirable noise, vibration, excessive engine heating, high exhaust gas temperatures, and harshness in engine operation.

Accordingly, the exemplary engine and ignition systems and methods described above include a facility for limiting overspeed operation of the engine, yet yield a reduction in the magnitude of, and wide variation between, maximum combustion chamber pressures. As a result, engine damage due to cyclical fatiguing attributed to excessive pressure spikes can be greatly reduced and virtually eliminated, and engine life increased. Similarly, maximum engine noise, vibration, and harshness can be significantly reduced. Moreover, excessive unburned fuel is not exhausted from the engine and nor are exhaust gases at excessively high temperatures.

While the forms of the invention herein disclosed constitute a presently preferred embodiment, many others are possible. For instance, those of ordinary skill in the art will recognize that the present invention is readily adaptable for use with any internal combustion engines, and is not limited to two-stroke and four-stroke spark ignition engines. It is not intended herein to mention all the possible equivalent forms or ramifications of the invention. It is understood that terms used herein are merely descriptive, rather than limiting, and that various changes may be made without departing from the spirit and scope of the invention as defined by the following claims.

What is claimed is:

1. A method of operating an engine, comprising the steps of:

determining engine speed;

activating ignition of said engine according to a predetermined timing schedule that references said determined engine speed;

suppressing ignition of said engine above at least one predetermined engine speed threshold to allow said engine speed to fall below said at least one predetermined engine speed threshold; and reactivating ignition of said engine according to timing that is retarded relative to said predetermined timing schedule for at least a portion of at least one revolution of said engine substantially when said engine speed has fallen below said at least one predetermined engine speed threshold.

2. The method of claim 1 wherein said reactivating step is carried out over one revolution of said engine.

3. The method of claim 1 wherein said reactivating step is carried out over a plurality of revolutions of said engine.

4. The method of claim 3 wherein said reactivating step includes reactivating ignition of said engine so as to gradually advance said timing back toward said predetermined timing schedule.

5. The method of claim 1 wherein said activating step includes calculating overall timing using a predetermined advance value of said predetermined timing schedule.

6. The method of claim 5 wherein said activating step includes said predetermined timing schedule being a look-up table that correlates engine speed to said predetermined advance value.

7. The method of claim 6 wherein said reactivating step includes adding a retarded timing value to said predetermined advance value to establish said timing that is retarded relative to said predetermined timing schedule.

8. The method of claim 1 wherein said reactivating step retards the timing for at least the first ignition combustion event occurring after the engine speed has fallen below said at least one predetermined engine speed threshold.

9. A method of controlling ignition of an engine, comprising the steps of:

receiving a signal representative of engine revolutions;

converting said signal into an engine speed value;

comparing said engine speed value to at least one predetermined engine speed threshold;

generating a timing advance signal in accordance with a predetermined timing schedule;

generating an ignition suppression signal when said engine speed value exceeds said at least one predetermined engine speed threshold; and generating a timing retard signal for at least a portion of at least one revolution of said engine substantially when said engine speed value falls below said at least one predetermined engine speed threshold.

10. The method of claim 9 wherein said step of generating a timing retard signal is carried out over one revolution of said engine.

11. The method of claim 9 wherein said step of generating a timing retard signal is carried out over a plurality of revolutions of said engine.

12. The method of claim 10 wherein said step of generating a timing retard signal includes generating a timing signal that varies over said plurality of revolutions of said engine so as to gradually advance said timing back toward said predetermined timing schedule.

13. The method of claim 9 wherein said step of generating a timing advance signal includes calculating overall timing using a predetermined advance value of said predetermined timing schedule.

14. The method of claim 13 wherein said step of generating a timing advance signal includes said predetermined timing schedule being a look-up table that correlates engine speed to said predetermined advance value.

15. The method of claim 14 wherein said step of generating a timing retard signal includes adding a retarded timing value to said predetermined advance value to establish said timing retard signal.

16. The method of claim 9 wherein said reactivating step retards the timing for at least the first ignition combustion event occurring after the engine speed has fallen below said at least one predetermined engine speed threshold.

17. An ignition control system for use with a light duty combustion engine, said system comprising an engine speed sensing apparatus, and an electronic processing device coupled to said engine speed sensing apparatus so as to receive signals indicative of engine speed from said engine speed sensing apparatus, said electronic processing device using a predetermined timing schedule to generate a timing advance signal based thereon, said electronic processing device generating an ignition suppression signal when said engine speed exceeds at least one predetermined engine speed threshold, said electronic processing device generating a timing retard signal for at least a portion of at least one revolution substantially when said engine speed has fallen below said at least one predetermined engine speed threshold.

18. The system of claim 17 wherein said timing retard signal is provided for retarding the timing for at least the first ignition combustion event occurring after the engine speed has fallen below said at least one predetermined engine speed threshold.

19. An ignition control system for an engine, comprising:

means for determining engine speed;

means for activating ignition of said engine according to a predetermined timing schedule that references said determined engine speed;

means for suppressing ignition of said engine above at least one predetermined engine speed threshold to allow said engine speed to fall below said at least one predetermined engine speed threshold; and means for reactivating ignition of said engine according to timing that is retarded relative to said predetermined timing schedule for at least a portion of at least one revolution of said engine substantially when said engine speed has fallen below said at least one predetermined engine speed threshold.

20. The system of claim 19 wherein said means for reactivating retards the timing for at least the first ignition combustion event occurring after the engine speed has fallen below said at least one predetermined engine speed threshold.

21. An ignition control system for an engine, comprising:

means for receiving a signal representative of engine revolutions;

means for converting said signal into an engine speed value;

means for comparing said engine speed value to at least one predetermined engine speed threshold;

means for generating a timing advance signal in accordance with a predetermined timing schedule;

means for generating an ignition suppression signal when said engine speed value exceeds said at least one predetermined engine speed threshold; and means for generating a timing retard signal for at least a portion of at least one revolution of said engine substantially when said engine speed value falls below said at least one predetermined engine speed threshold.

22. The system of claim 21 wherein said means for generating a timing retard signal operates to retard the timing for at least the first ignition combustion event occurring after the engine speed has fallen below said at least one predetermined engine speed threshold.

* * * * *